United States Patent [19]

Fukuda et al.

[11] Patent Number: 4,469,922

[45] Date of Patent: Sep. 4, 1984

[54] PRESSURE RESPONSIVE SWITCH

[75] Inventors: Hiroaki Fukuda, Kariya; Tsukasa Watanabe, Toyota, both of Japan

[73] Assignee: Aisin Seiki Kabushiki Kaisha, Kariya, Japan

[21] Appl. No.: 382,765

[22] Filed: May 27, 1982

[30] Foreign Application Priority Data

Jun. 1, 1981 [JP] Japan ..... 56-084074

[51] Int. Cl.[3] ..... H01H 35/34

[52] U.S. Cl. ..... 200/83 R

[58] Field of Search ..... 200/81.5, 83 R, 83 B, 200/83 N, 83 P, 83 S, 83 SA, 83 WM, 302.1

[56] References Cited

U.S. PATENT DOCUMENTS 2,648,732 8/1953 Starbird ..... 200/83 B X 3,688,064 8/1972 Myers ..... 200/83 N 3,784,772 1/1974 Nelson ..... 200/83 B X

*Primary Examiner*—J. R. Scott

*Attorney, Agent, or Firm*—Oblon, Fisher, Spivak, McClelland & Maier

[57] ABSTRACT

A pressure responsive switch having an atmospheric pressure chamber including electrical contacts which are sealed hermetically by a flexible pleated cover whereby the flexible pleated cover deforms in accordance with the expansion and contraction of the atmosphere in the atmospheric pressure chamber. The alteration of the temperature surrounding the atmospheric chamber provides for the expansion and contraction of the atmosphere with the atmospheric pressure chamber and the pleated cover maintains the atmospheric pressure constant within the pressure chamber.

8 Claims, 3 Drawing Figures

PRESSURE RESPONSIVE SWITCH

FIELD OF THE INVENTION

The present invention relates to a pressure responsive switch and more particularly to an improvement in an electrical switch which is operated by a preselected value of differential pressure in accordance with change in a pneumatic pressure as an input signal pressure as compared to a constant atmospheric pressure as a constant pressure.

DESCRIPTION OF THE PRIOR ART

A conventional pressure responsive switch is disclosed for example in U.S. Pat. No. 3,688,064 to Myers. Such conventional pressure responsive switch construction is provided with a hermetically sealed atmospheric pressure chamber including electrical contacts. The volume of the atmospheric pressure chamber is kept constant by a waterproof cover or dust-seal cover so as to prevent corrosion of the electrical contacts caused by moisture and/or dust. The pressure in the sealed atmospheric pressure chamber may be changed in response to change in temperature. Thus, because of a temperature change, the pressure responsive switch will not operate at the preselected value of input signal pressure and will therefore malfunction when it attempts to operate at a value of pressure which is different from the preselected value of input signal pressure.

SUMMARY OF THE INVENTION

An object of the present invention is, therefore, to provide an improved pressure responsive switch which overcomes the above disadvantages in the conventional pressure responsive switch.

Another object of the present invention is to provide an improved pressure responsive switch which is low in cost and simple in construction.

According to the present invention, the atmospheric pressure chamber including electrical contacts is sealed hermetically by a flexible pleated cover. As a result, the flexible pleated cover deforms in accordance with the expansion and contraction of atmosphere in the atmospheric pressure chamber by alternation of temperature at the atmospheric pressure chamber and constantly maintaining atmospheric pressure in the atmospheric pressure chamber.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE INVENTION

Figure 1:
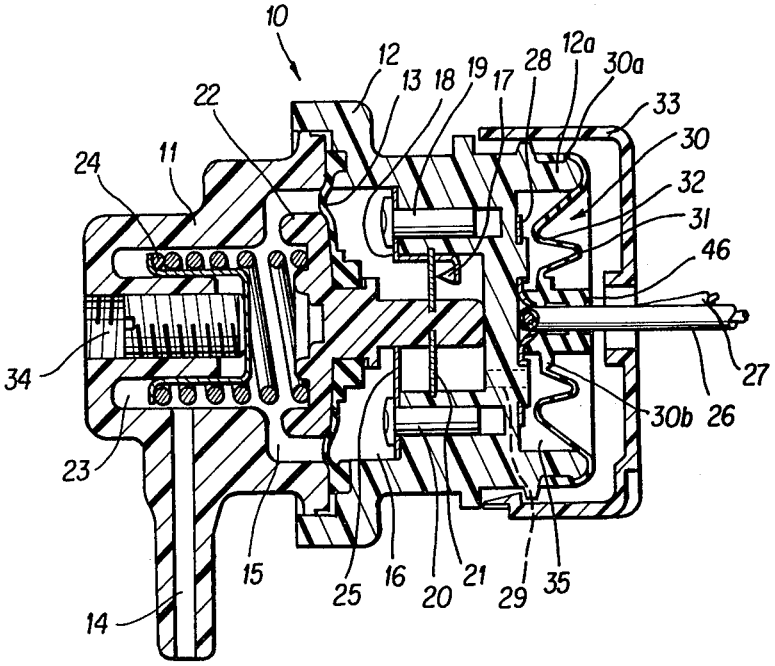
FIG. 1 is a vertical transverse sectional view of a pressure responsive switch according to the present invention.

Referring now to the drawings, wherein like reference numerals designate identical or corresponding parts throughout the several views, and more particularly to FIG. 1 thereof, there is shown a pressure responsive switch 10 which includes a first housing 11 and a second housing 12 forming a casing. A diaphragm 13 is held at the outer circular portion of the casing between the first housing 11 and the second housing 12. The inside of the casing is divided into a signal pressure chamber 15 and an atmospheric pressure chamber 16 by diaphragm 13.

The signal pressure chamber 15 receives a signal vacuum pressure passing through input signal port 14 formed in the first housing 11. The atmospheric pressure chamber 16 receives atmospheric air. A terminal 18 having a stationary contact 17 is fixed to the second housing 12 in the atmospheric chamber 16 by a screw 19. A terminal 25 is fixed by a screw 20 with one end of a movable contact 21 and in turn with the second housing 12 in the atmospheric chamber 16. The other end of movable contact 21 is able to be movable between contact and non-contact positions with the stationary contact 17.

The pressure plate 22 is fixed to the central portion of diaphragm 13 with a portion of the plate 22 engaging a central portion of movable contact 21. The pressure plate 22 is biased to the right in FIG. 1 by biasing spring 24 so that movable contact 21 is brought in contact with stationary contact 17.

A lead wire 26 which is electrically connected to terminal 18 and a lead wire 27 which is electrically connected to terminal 25 are clamped on second housing 12 by clamping member 28. The open end portion of second housing 12 communicates with atmospheric pressure chamber 16 through hole 29 and is sealed hermetically by a flexible pleated cover 30 of rubber.

Outer circular portion **30*a* of flexible pleated cover 30 is hermetically engaged with circular flange portion 12*a* of second housing 12. Inner circular portion 30*b* is hermetically engaged with lead wires 26, 27 and clamping member 28 by a holding member 46. The flexible pleated cover 30 has a circular portion 31 convex in the direction away from the housing 12 and a circular portion 32 concave in the direction away from housing 12. The circular convex portion 31 and the circular concave portion 32** being formed concentrically to each other.

A chamber 35 formed by second housing 12 and flexible pleated cover 30 communicates with atmospheric pressure chamber 16 through hole 29.

The left side surface of flexible pleated cover 30 as shown in FIG. 1 contacts the top rounded end of flange portion **12*a*. A protection cap 33 prevents the damaging of flexible pleated cover 30**.

An adjustable screw 34 adjusts the biasing force of spring 24. The right end of pressure plate 22 as shown in FIG. 1 contacts with second housing 12 and operates as a stopper to limit the pressure between movable contact 21 and stationary contact 17. The reference numeral 23 shows a spring retainer of spring 24.

When the signal vacuum pressure as opposed to atmospheric pressure which is introduced into signal pressure chamber 15, is lower being nearly atmospheric pressure than a preselected pressure preselected by biasing force of spring 24, the diaphragm 13 and pressure plate 22 are moved to the position showing in FIG. 1 by biasing force of spring 24, whereby the movable contact 21 is contacted with stationary contact 17. When signal vacuum pressure in signal pressure chamber 15 is higher being nearly vacuum than the preselected pressure, the diaphragm 13 and pressure plate 22 are moved to the left in FIG. 1 from the position illustrated in FIG. 1 against the biasing force of spring 24, whereby the movable contact 21 is moved away from stationary contact 17.

Figure 2:
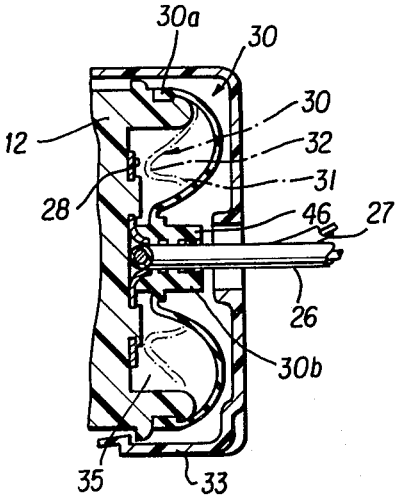
FIG. 2 is a view similar to FIG. 1 illustrating a principal portion of the present invention wherein the expansion condition of a flexible pleated cover is shown.

When there is an increase in temperature surrounding pressure responsive switch 10, for example, if temperature surrounding switch 10 rises up from the normal temperature (about 20° C.), the circular concave portion 32 of flexible pleated cover 30 deforms rightwardly in accordance with the effect of expansion of atmosphere in the atmospheric pressure chamber 16 and chamber 35 in response to increase in temperature. The volume of chamber 35 increases thereby maintaining the pressure in atmospheric pressure chamber 16 and chamber 35 at a constant atomspheric pressure. The condition of deformation of flexible pleated cover 30 in accordance with an increase in temperature is shown in FIG. 2 wherein flexible pleated cover 30 is deformed into a single circular convex shape as shown by the solid line from circular convex portion 31 and circular concave portion 32 as shown in dotted lines. Therefore, the pressure in atmospheric pressure chamber 16 and chamber 35 is kept constant, for example, atmospheric pressure, even if the temperature surrounding switch 10 rises up to 100° C.

Figure 3:
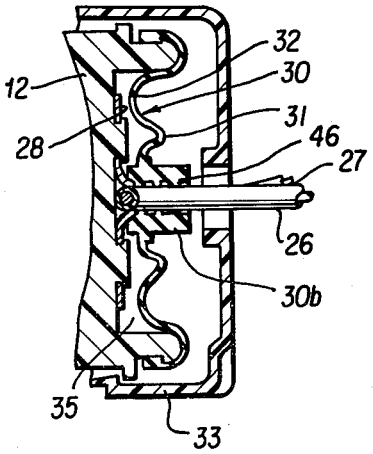
FIG. 3 is a view similar to FIG. 1 illustrating a principal portion of the present invention wherein the contraction condition of the flexible pleated cover is shown.

On the other hand, when the temperature of the surrounding switch 10 decreases from the normal temperature, the circular convex portion 31 of flexible pleated cover 30 deforms leftwardly in accordance with the effect of contraction of atmosphere in the atmospheric pressure chamber 16 and chamber 35. The volume of chamber 35 decreases in accordance with the effect of contraction of atmosphere in the atmospheric pressure chamber 16 and chamber 35, so that the pressure in atmospheric pressure chamber 16 and chamber 35 is constantly kept at atmospheric pressure. The deformation of flexible pleated cover 30 in accordance with a decrease in temperature is shown in FIG. 3 when the temperature is, for example, dropped to −30° C. The circular convex portion 31 is drawn back towards second housing 12, and the radius of curvature of the circular concave portion 32 is increased resulting in a decreased volume of chamber 35 in comparison with the condition showing in FIG. 1. Consequently, the vacuum responsive switch 10 may operate at a preselected pressure in any temperature.

While the form of the invention now prepared has been disclosed as a switch being of the normally closed type, other forms may be utilized, for example, the switch being normally open or the switch being operated in accordance with positive pressure.

Obviously, numerous modifications and variations of the present invention are possible in light of the above teachings. It is therefore to be understood that within the scope of the appended claims, the invention may be practiced otherwise than as specifically described herein.

What is claimed as new and is intended to be secured by Letters Patent is:

1. A pressure responsive switch comprising:

a casing means;

an atmospheric pressure chamber being formed in said casing means and receiving atmospheric air;

a signal pressure chamber being formed in said casing and receiving pneumatic pressure;

a diaphragm dividing said casing into said atmospheric pressure chamber and said signal pressure chamber;

an electrical switch means having a movable contact and a stationary contact being installed in said atmospheric chamber and being operated by movement of said diaphragm;

a flexible pleated cover being sealed hermetically and being adjacent said atmospheric pressure chamber and forming with said casing means a pressure maintenance chamber in communication with said atmospheric chamber through a hole in said casing means so as to maintain the pressure of said atmospheric pressure constant in accordance with a change in the temperature surrounding said atmospheric pressure chamber;

a pressure plate fixed to said diaphragm which pressure plate is movable to contact with said casing means so as to limit the contacting load of said movable contact and said stationary contact; and a spring means for biasing said pressure plate to maintain contact between said movable contact and said stationary contact when the pressure in said signal pressure chamber is less than a preselected pressure.

2. The pressure responsive switch of claim 1, wherein said flexible pleated cover has a circular convex portion and a circular concave portion each defined in a direction away from said casing.

3. The pressure responsive switch according to claim 1 or 2 wherein said preselected pressure is determined by a screw means for adjusting said spring means.

4. The pressure responsive switch according to claim 1 or 2 wherein said flexible pleated cover is deformed into a single circular convex shape in accordance with an increase in the temperature surrounding said atmospheric pressure chamber.

5. The pressure responsive switch according to claim 2 wherein said circular convex portion is drawn back toward the body of said casing and the radius of curvature of said circular concave portion is increased in accordance with a decrease in the temperature surrounding said atmospheric chamber.

6. The pressure responsive switch according to claim 1 or 2 wherein said pressure plate is fixed to the central portion of said diaphragm and a portion of said plate engages with a central portion of said movable contact.

7. The pressure responsive switch according to claim 1 or 2 wherein said case comprises a first housing and a second housing separated by said diaphragm.

8. The pressure responsive switch according to claim 1, wherein said flexible pleated cover has a means for holding a lead wire connected with said electrical switch means.

* * * * *